US010690319B2

(12) United States Patent
Hayashi et al.

(10) Patent No.: US 10,690,319 B2
(45) Date of Patent: Jun. 23, 2020

(54) LIGHT EMITTING DEVICE

(71) Applicant: TOYODA GOSEI CO., LTD., Kiyosu-shi (JP)

(72) Inventors: Kento Hayashi, Kiyosu (JP); Yuhki Kawamura, Kiyosu (JP); Masao Kamiya, Kiyosu (JP); Satoshi Wada, Kiyosu (JP); Masaaki Osawa, Kiyosu (JP)

(73) Assignee: TOYODA GOSEI CO., LTD., Kiyosu-Shi, Aichi-Ken (JP)

( * ) Notice: Subject to any disclaimer, the term of this patent is extended or adjusted under 35 U.S.C. 154(b) by 0 days.

(21) Appl. No.: 16/353,144

(22) Filed: Mar. 14, 2019

(65) Prior Publication Data

US 2019/0285249 A1 Sep. 19, 2019

(30) Foreign Application Priority Data

Mar. 15, 2018 (JP) ..... 2018-048623

(51) Int. Cl.

| | |
|---|---|
| ***F21V 33/00*** | (2006.01) |
| ***F21V 9/30*** | (2018.01) |
| ***F21V 3/00*** | (2015.01) |
| *F21Y 115/30* | (2016.01) |

(52) U.S. Cl.
CPC ..... *F21V 9/30* (2018.02); *F21V 3/00* (2013.01); *F21Y 2115/30* (2016.08)

(58) Field of Classification Search
None
See application file for complete search history.

(56) References Cited

U.S. PATENT DOCUMENTS 7,068,690 B2 * 6/2006 Okazaki ..... H01S 5/4012 372/36
2017/0256685 A1 9/2017 Schug

FOREIGN PATENT DOCUMENTS

JP 2009-170723 A 7/2009
JP 2017-526192 A 9/2017

* cited by examiner

*Primary Examiner* — Vip Patel
(74) *Attorney, Agent, or Firm* — McGinn IP Law Group, PLLC

(57) ABSTRACT

A light emitting device includes: a first semiconductor laser element; a second semiconductor laser element; and a light exit surface which emits light from the first semiconductor laser element and the second semiconductor laser element. The first semiconductor laser element is disposed at a position farther than the second semiconductor laser element as seen from a flat surface including a point on a surface of the light exit surface and perpendicular to a light extraction direction.

13 Claims, 9 Drawing Sheets

LIGHT EMITTING DEVICE

This application is based upon and claims the benefit of priority from prior Japanese patent application No. 2018-048623, filed on Mar. 15, 2018, the entire contents of which are incorporated herein by reference.

TECHNICAL FIELD

The technical field of the present specification relates to a light emitting device.

BACKGROUND ART

A light emitting device may include a plurality of light emitting elements to realize a high light intensity. In this case, the plurality of light emitting elements are generally arranged in an array on a flat surface such as a substrate. In this technique, since the area of the light exit surface is large, the luminance is low.

On the other hand, a technique of collecting light from a plurality of elements to a diffusion member or the like is developed. For example, JP-A-2009-170723 discloses a light emitting device including a plurality of semiconductor laser elements 120 and a diffusion member 130 (see FIG. 8 of JP-A-2009-170723). Light from the plurality of semiconductor laser elements 120 disposed on a flat surface is irradiated to the diffusion member 130. In JP-T-2007-526192, two laser diodes 104, 302 are disposed on a plate surface of a substrate 102 (see FIG. 3 of JP-T-2007-526192).

However, the semiconductor laser elements are still arranged on a flat surface. Therefore, a total area of the light exit surface of the light emitting device is increased. As the total area of the light exit surface increases, the luminance decreases.

The technique of the present specification is made to solve the problems of the above-described related techniques. A problem to be solved by the technique of the present specification is to provide a light emitting device capable of realizing high luminance and miniaturization of the device.

SUMMARY OF INVENTION

According to an aspect of the invention, there is provided a light emitting device comprising: a first semiconductor laser element; a second semiconductor laser element; and a light exit surface which emits light from the first semiconductor laser element and the second semiconductor laser element, wherein the first semiconductor laser element is disposed at a position farther than the second semiconductor laser element as seen from a flat surface including a point on a surface of the light exit surface and perpendicular to a light extraction direction.

DESCRIPTION OF EMBODIMENTS

First Embodiment

1. Light Emitting Device

Figure 1:
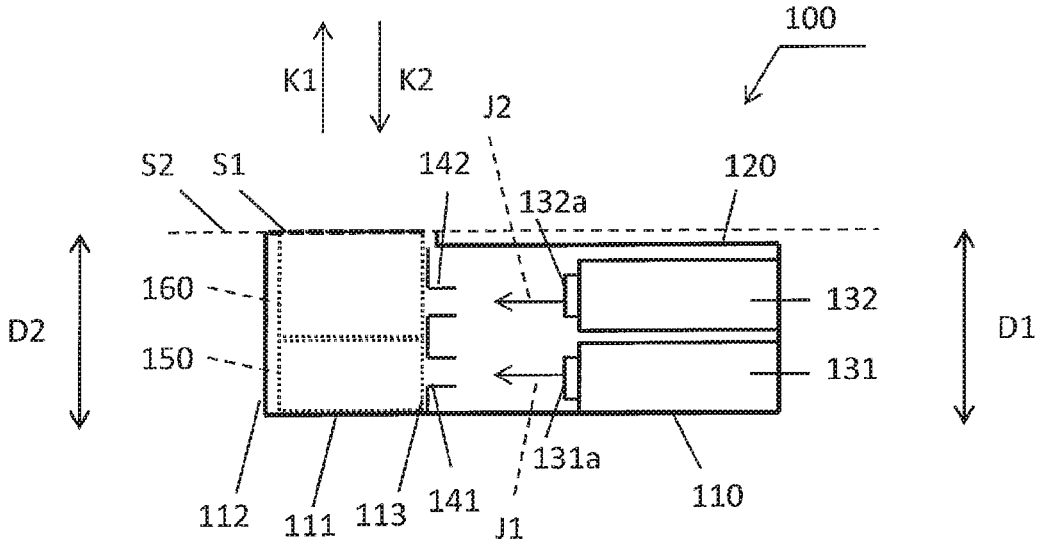
FIG. 1 is a diagram showing a schematic configuration of a light emitting device according to a first embodiment.

FIG. 1 is a diagram showing a schematic configuration of a light emitting device 100 according to a first embodiment. As shown in FIG. 1, the light emitting device 100 includes a housing 110, a mounting substrate 120, a first semiconductor laser element 131, a second semiconductor laser element 132, a first opening part 141, a second opening part 142, a wavelength conversion unit 150, and a scattering unit 160. The light emitting device 100 includes a light exit surface S1. The light exit surface S1 is a surface for extracting light from the light emitting device 100 to the outside. The light exit surface S1 emits light from the first semiconductor laser element 131 and the second semiconductor laser element 132. A light extraction direction K1 is perpendicular to the light exit surface S1.

The housing 110 houses the first semiconductor laser element 131, the second semiconductor laser element 132, the wavelength conversion unit 150, and the scattering unit 160. The housing 110 has a first surface 111, a second surface 112, and a third surface 113.

The first surface 111 faces the light exit surface S1. The second surface 112 faces the first opening part 141 and the second opening part 142. The third surface 113 faces the second surface 112. The first surface 111, the second surface 112, and the third surface 113 are mirror surfaces. The first surface 111, the second surface 112, and the third surface 113 face at least one of the wavelength conversion unit 150 and the scattering unit 160. Therefore, the first surface 111, the second surface 112, and the third surface 113 reflect light scattered by the wavelength conversion unit 150 and the scattering unit 160.

The mounting substrate 120 is a substrate for mounting the first semiconductor laser element 131 and the second semiconductor laser element 132. The mounting substrate 120 faces the housing 110. The mounting substrate 120 houses the first semiconductor laser element 131 and the second semiconductor laser element 132 together with the housing 110.

The first semiconductor laser element 131 irradiates a laser beam passing through the first opening part 141 and entering the wavelength conversion unit 150. The laser beam emitted by the first semiconductor laser element 131 is a blue laser beam.

The second semiconductor laser element 132 irradiates a laser beam passing through the second opening part 142 and entering the scattering unit 160. The laser beam emitted by the second semiconductor laser element 132 is a blue laser beam.

The first opening part 141 allows the laser beam from the first semiconductor laser element 131 to pass therethrough.

The first opening part 141 allows the laser beam from the first semiconductor laser element 131 to enter the wavelength conversion unit 150. The second opening part 142 allows a laser beam from the second semiconductor laser element 132 to pass therethrough. The second opening part 142 allows the laser beam from the second semiconductor laser element 132 to enter the scattering unit 160. The inner diameters of the first opening part 141 and the second opening part 142 are sufficiently small. The wavelength conversion unit 150 and the scattering unit 160 scatter the laser beams. Therefore, there is almost no component of light returning from the first opening part 141 to the first semiconductor laser element 131. There is almost no component of light returning from the second opening part 142 to the second semiconductor laser element 132.

The wavelength conversion unit 150 converts the wavelength of the laser beam emitted from the first semiconductor laser element 131. The wavelength conversion unit 150 is, for example, a phosphor. More specifically, phosphors such as a YAG phosphor, an α-sialon phosphor, a BOS phosphor, β-sialon, $(Ca, Sr)_2Si_5N_8$: Eu are mixed in a material such as alumina, glass, or resin. The above materials are merely examples, and other materials may be used. The wavelength conversion unit 150 also plays a role of scattering the laser beam emitted from the first semiconductor laser element 131. The wavelength conversion unit 150 is disposed at a position farther than the scattering unit 160 as seen from the light exit surface S1.

The scattering unit 160 scatters the laser beam emitted from the second semiconductor laser element 132 and the laser beam passing through the wavelength conversion unit 150 and entering the first semiconductor laser element 131. The scattering unit 160 is a translucent material containing a light scattering material. Examples of the light scattering material include particles of silica and titanium oxide. Examples of the translucent material include glass and resin. Of course, other materials may be used.

2. Arrangement of Semiconductor Laser Element

The first semiconductor laser element 131 is disposed at a position farther than the second semiconductor laser element 132 as seen from the light exit surface S1. The first semiconductor laser element 131 is disposed at a position farther than the second semiconductor laser element 132 as seen from a flat surface S2 including a point on a surface of the light exit surface S1 and perpendicular to the light extraction direction K1. Therefore, an emission part 131*a* of the first semiconductor laser element 131 is also disposed at a position farther than an emission part 132*a* of the second semiconductor laser element 132 as seen from the flat surface S2 including a point on the surface of the light exit surface S1 and perpendicular to the light extraction direction K1.

The first semiconductor laser element 131 is located at an inner side of the second semiconductor laser element 132 as seen from a direction K2. The direction K2 is opposite to the light extraction direction K1. The first semiconductor laser element 131 and the second semiconductor laser element 132 are laminated. A lamination direction D1 thereof is parallel to the light extraction direction K1. That is, the lamination direction D1 is perpendicular to the light exit surface S1.

The first semiconductor laser element 131 and the second semiconductor laser element 132 emit the laser beams approximately parallel to the light exit surface S1. The first semiconductor laser element 131 emits the laser beam in the direction of an arrow J1 in FIG. 1. The second semiconductor laser element 132 emits the laser beam in the direction of an arrow J2 in FIG. 1. The first semiconductor laser element 131 and the second semiconductor laser element 132 irradiate the light exit surface S1 with the laser beams at an angle inclined within a range of 0° to 10°. This numerical range is merely an example, and the angle may be out of this range. In FIG. 1, the angle between the directions (J1, J2) of the laser beams emitted from the first semiconductor laser element 131 and the second semiconductor laser element 132 and a surface direction of the light exit surface S1 is 0°.

The wavelength conversion unit 150 and the scattering unit 160 are laminated along a lamination direction D2. The lamination direction D2 of the wavelength conversion unit 150 and the scattering unit 160 is parallel to the lamination direction D1 of the first semiconductor laser element 131 and the second semiconductor laser element 132. The scattering unit 160 and the wavelength conversion unit 150 are disposed in this order as seen from the light exit surface S1.

3. Light from Semiconductor Laser Element

The wavelength of the laser beam emitted from the first semiconductor laser element 131 is converted and scattered by the wavelength conversion unit 150. The scattered light directly enters the scattering unit 160, or is reflected by the first surface 111, the second surface 112, and the third surface 113 and then enters the scattering unit 160.

The laser beam emitted from the second semiconductor laser element 132 is scattered by the scattering unit 160. There is a laser beam entering from the wavelength conversion unit 150 in the scattering unit 160. Therefore, in the scattering unit 160, the blue laser beam from the second semiconductor laser element 132 and the laser beam whose wavelength is converted from the first semiconductor laser element 131 coexist. Therefore, the light emitting device 100 emits white light from the light exit surface S1. Of course, the light emitted from the light exit surface S1 has a light distribution characteristic of a certain expansion to the light extraction direction K1.

4. Effects of the Embodiment

In the light emitting device 100 of the present embodiment, the first semiconductor laser element 131 is hidden behind the second semiconductor laser element 132 as seen from the reverse direction K2 of the light extraction direction K1. The output of the laser beam is also approximately doubled. Therefore, the light emitting device 100 includes a housing 110 which is of high luminance and miniaturized in an in-plane direction of the light exit surface S1.

The emission directions J1, J2 from the first semiconductor laser element 131 and the second semiconductor laser element 132 are parallel to the light exit surface S1. Therefore, laser beams are not directly emitted to the outside of the light emitting device 100. Therefore, the light emitting device has high safety.

The light exit surface S1 is set independently of the first semiconductor laser element 131 and the second semiconductor laser element 132. For example, the light exit surface S1 may be designed to be very small.

5. Modification 5-1. Taper of Opening Parts

Figure 2:
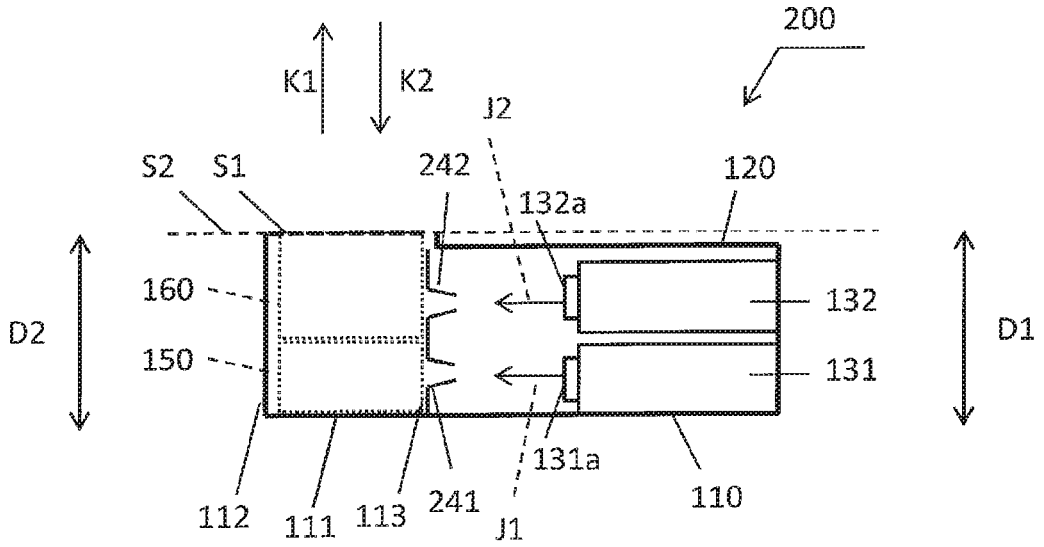
FIG. 2 is a diagram (1) showing a schematic configuration of a light emitting device according to a modification of the first embodiment.

FIG. 2 is a diagram (1) showing a schematic configuration of a light emitting device according to a modification of the first embodiment. A light emitting device 200 includes a first opening part 241 and a second opening part 242. The first opening part 241 is widened as approaching the wavelength conversion unit 150. The first opening part 241 is widened as getting away from the first semiconductor laser element 131. The second opening part 242 is widened as approaching the scattering unit 160. The second opening part 242 is widened as getting away from the second semiconductor laser element 132. The first opening 241 and the second opening 242 are widened toward the second surface 112. Therefore, the laser beams from the wavelength conversion unit 150 and the scattering unit 160 are suppressed from being directed to the first semiconductor laser element 131 and the second semiconductor laser element 132. The inner surfaces of the first opening 241 and the second opening 242 may be mirror surfaces.

5-2. Half Mirror

Figure 3:
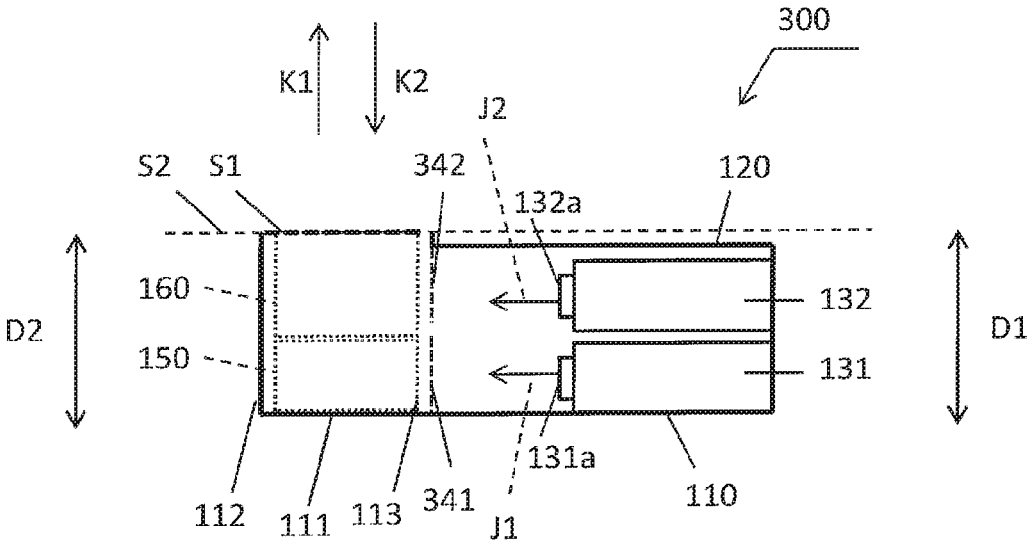
FIG. 3 is a diagram (2) showing a schematic configuration of a light emitting device according to a modification of the first embodiment.

FIG. 3 is a diagram (2) showing a schematic configuration of a light emitting device according to a modification of the first embodiment. A light emitting device 300 includes a first half mirror 341 and a second half mirror 342. The first half mirror 341 is disposed at a position between the first semiconductor laser element 131 and the wavelength conversion unit 150. The second half mirror 342 is disposed at a position between the second semiconductor laser element 132 and the scattering unit 160. The first half mirror 341 transmits the light from the first semiconductor laser element 131 and hardly transmits the light scattered by the wavelength conversion unit 150. The first half mirror 341 may be a material capable of selecting a wavelength to be transmitted as described later. The second half mirror 342 transmits the light from the second semiconductor laser element 132 and hardly transmits the light scattered by the scattering unit 160.

5-3. Light Selective Transmission Member

Instead of the first half mirror 341, a light selective transmission member may be disposed. The light selective transmission member is disposed at a position between the first semiconductor laser element 131 and the wavelength conversion unit 150. The light selective transmission member may be a material which transmits blue light and reflects yellow light.

5-4. Tilted Mirror

Figure 4:
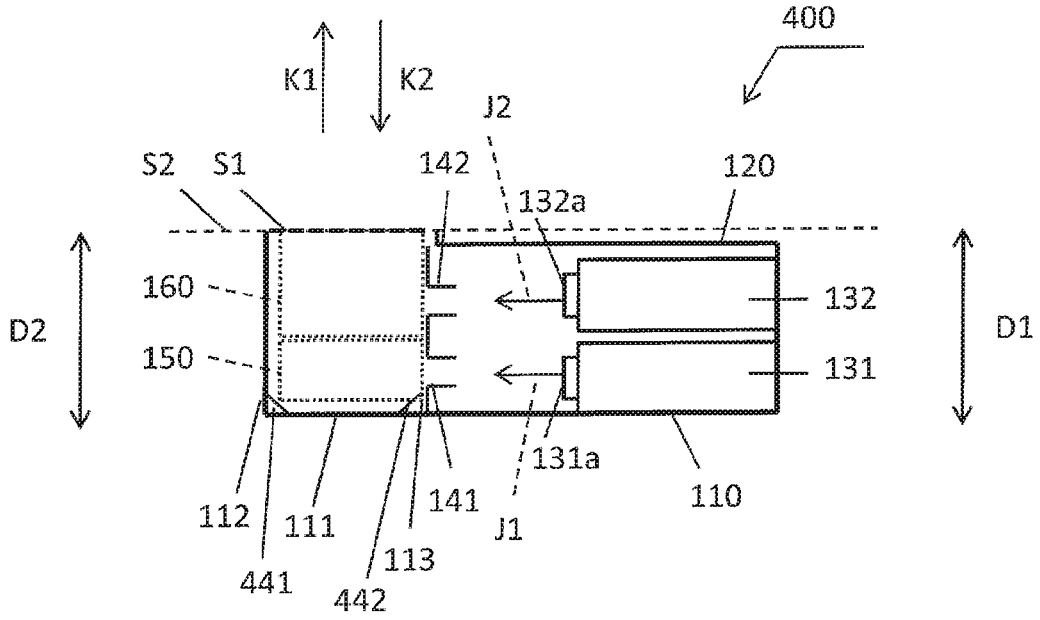
FIG. 4 is a diagram (3) showing a schematic configuration of a light emitting device according to a modification of the first embodiment.

FIG. 4 is a diagram (3) showing a schematic configuration of a light emitting device according to a modification of the first embodiment. A light emitting device 400 includes a first inclined mirror 441 and a second inclined mirror 442. The first inclined mirror 441 and the second inclined mirror 442 are mirror surfaces inclined with respect to the first surface 111. The first inclined mirror 441 and the second inclined mirror 442 are inclined with respect to the light exit surface S1. Therefore, light distribution characteristics of the light emitting device 400 are slightly different from light distribution characteristics of the light emitting device 100 of the present embodiment.

5-5. Diffusion Mirror

Figure 5:
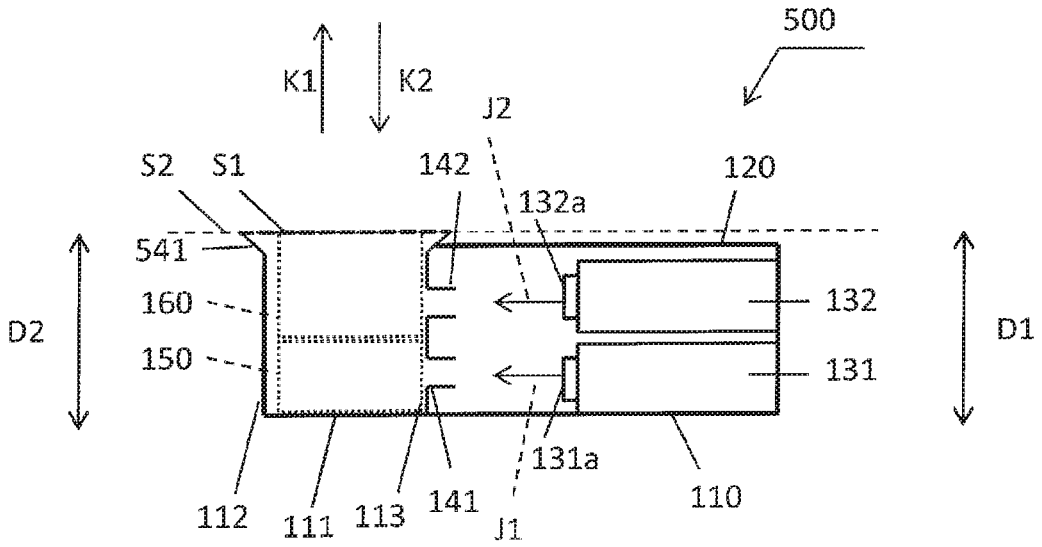
FIG. 5 is a diagram (4) showing a schematic configuration of a light emitting device according to a modification of the first embodiment.

FIG. 5 is a diagram (4) showing a schematic configuration of a light emitting device according to a modification of the first embodiment. A light emitting device 500 includes a diffusion mirror 541. The diffusion mirror 541 is disposed so as to surround the light exit surface S1. The diffusion mirror 541 is widened toward the light exit surface S1. Therefore, the light from the scattering unit 160 is preferably diffused.

5-6. Diffusion Half Mirror

Figure 6:
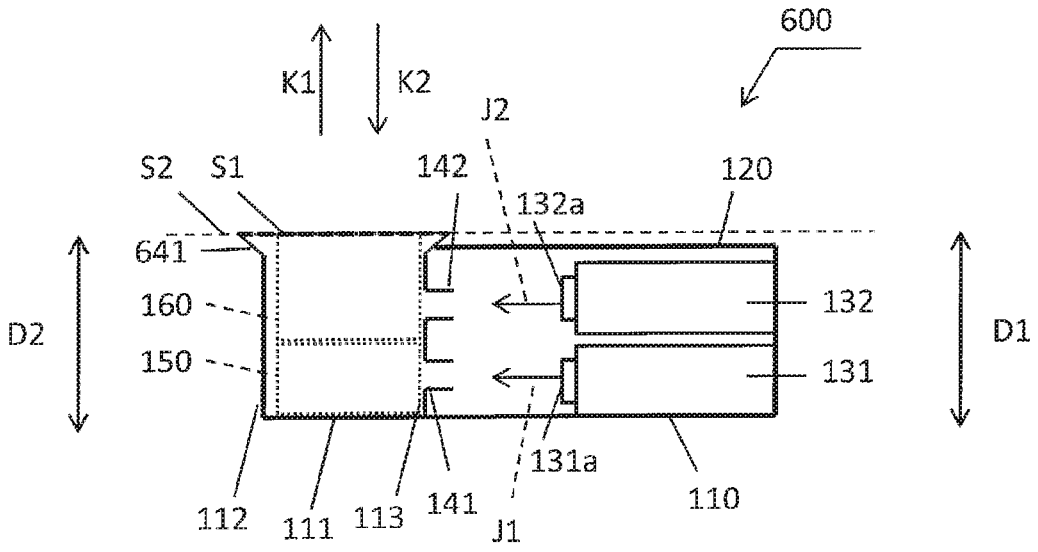
FIG. 6 is a diagram (5) showing a schematic configuration of a light emitting device according to a modification of the first embodiment.

FIG. 6 is a diagram (5) showing a schematic configuration of a light emitting device according to a modification of the first embodiment. A light emitting device 600 includes a diffusion half mirror 641. The diffusion half mirror 641 surrounds a scattering layer 160 on a light exit surface S1 side. The diffusion half mirror 641 may or may not be widened toward the light exit surface S1.

5-7. Light Exit Surface with Curved Surface

As in the first embodiment, the flat surface S2 including a point on the surface of the light exit surface S1 and perpendicular to the light extraction direction K1 can be defined even if the light exit surface S1 has a curved surface.

5-8. Combination

The above modifications may be freely combined.

6. Summary of Present Embodiment

In the light emitting device 100 of the present embodiment, the first semiconductor laser element 131 is disposed at a position farther than the second semiconductor laser element 132 as seen from the light exit surface S1. The intensity of the light from the light exit surface S1 is about twice the normal intensity. Therefore, the luminance of the light emitting device 100 is very high as compared with related ones. The light exit surface S1 can be designed separately from the disposition of the semiconductor laser elements. That is, the degree of freedom of design is high.

Second Embodiment

A second embodiment will be described. In the second embodiment, two types of semiconductor laser elements having different wavelengths are used.

1. Light Emitting Device

Figure 7:
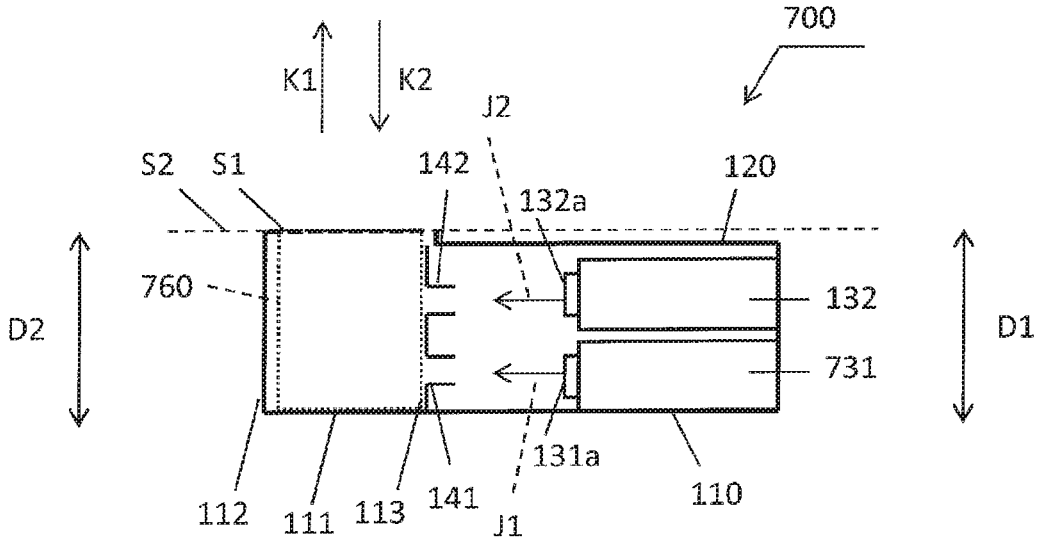
FIG. 7 is a diagram showing a schematic configuration of a light emitting device according to a second embodiment.

FIG. 7 is a diagram showing a schematic configuration of a light emitting device 700 according to the second embodiment. As shown in FIG. 7, a light emitting device 700 includes the housing 110, the mounting substrate 120, a first semiconductor laser element 731, the second semiconductor laser element 132, the first opening part 141, the second opening part 142, and a scattering unit 760.

The light emitted by the first semiconductor laser element 731 is a yellow laser beam. The light emitted by the second semiconductor laser element 132 is a blue laser beam. Accordingly, the wavelength of the laser beam of the first semiconductor laser element 731 is different from that of the laser beam of the second semiconductor laser element 132.

The light emitting device 700 does not have a wavelength conversion unit. The first semiconductor laser element 731 and the second semiconductor laser element 132 irradiate the scattering unit 760 with laser beams. The scattering unit 760 scatters the laser from the first semiconductor laser element 731 and the laser from the second semiconductor laser element 132.

2. Modification

The modifications of the first embodiment may be appropriately combined with the second embodiment.

Third Embodiment

A third embodiment will be described. In the third embodiment, three types of semiconductor laser elements are used.

1. Light Emitting Device

Figure 8:
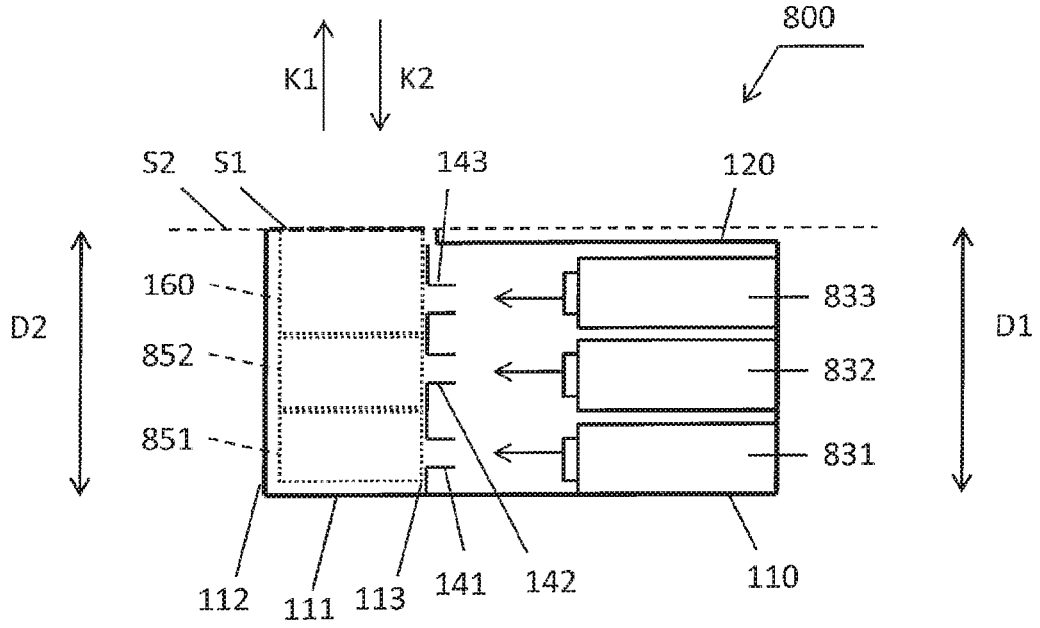
FIG. 8 is a diagram showing a schematic configuration of a light emitting device according to a third embodiment.

FIG. 8 is a diagram showing a schematic configuration of a light emitting device 800 according to the third embodiment. As shown in FIG. 8, the light emitting device 800 includes the housing 110, the mounting substrate 120, a first semiconductor laser element 831, a second semiconductor laser element 832, a third semiconductor laser element 833, the first opening part 141, the second opening part 142, a third opening part 143, a first wavelength conversion unit 851, a second wavelength conversion unit 852, and the scattering unit 160.

The first semiconductor laser element 831 is disposed at a position farther than the second semiconductor laser element 832 as seen from the flat surface S2 including a point on the surface of the light exit surface S1 and perpendicular to the light extraction direction K1. The second semiconductor laser element 832 is disposed at a position farther than the third semiconductor laser element 833 as seen from the flat surface S2 including a point on the surface of the light exit surface S1 and perpendicular to the light extraction direction K1.

The second wavelength conversion unit 852 is disposed at a position farther than the scattering unit 160 as seen from the light exit surface S1. The first wavelength conversion unit 851 is disposed at a position farther than the second wavelength conversion unit 852 as seen from the light exit surface S1.

All of the first semiconductor laser element 831, the second semiconductor laser element 832, and the third semiconductor laser element 833 emit blue laser beams.

The first semiconductor laser element 831 irradiates the first wavelength conversion unit 851 with a laser beam. The second semiconductor laser element 832 irradiates the second wavelength conversion unit 852 with a laser beam. The third semiconductor laser element 833 irradiates the scattering unit 160 with a laser beam.

The first wavelength conversion unit 851 converts the blue laser beam from the first semiconductor laser element 831 into a red laser beam. The second wavelength conversion unit 852 converts the blue laser beam from the second semiconductor laser element 832 into a green laser beam. That is, the wavelength of the laser beam converted by the second wavelength conversion unit 852 is shorter than that of the laser beam converted by the first wavelength conversion unit 851.

Therefore, light of three types of wavelengths are mixed in the scattering unit 160. The light emitting device 800 emits white light from the light exit surface S1.

2. Modification

The modifications of the first embodiment may be appropriately combined with the third embodiment.

Fourth Embodiment

A fourth embodiment will be described. In the fourth embodiment, semiconductor laser elements emitting light of three colors of red, green and blue are used.

1. Light Emitting Device

Figure 9:
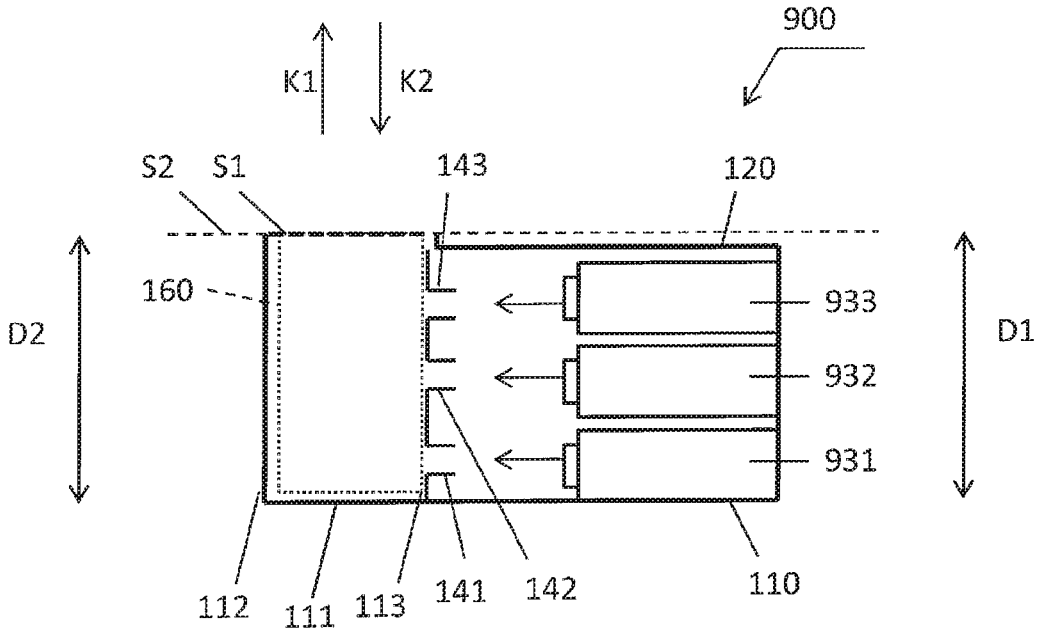
FIG. 9 is a diagram showing a schematic configuration of a light emitting device according to a fourth embodiment.

FIG. 9 is a diagram showing a schematic configuration of a light emitting device 900 according to the fourth embodiment. As shown in FIG. 9, the light emitting device 900 includes the housing 110, the mounting substrate 120, a first semiconductor laser element 931, a second semiconductor laser element 932, a third semiconductor laser element 933, the first opening part 141, the second opening part 142, the third opening part 143, and the scattering unit 160.

The wavelength of the laser beam of the first semiconductor laser element 931, the wavelength of the laser beam of the second semiconductor laser element 932 and the wavelength of the laser beam of the third semiconductor laser element 933 are different from each other. The light emitted by the first semiconductor laser element 931 is a red laser beam. The light emitted by the second semiconductor laser element 932 is a green laser beam. The light emitted by the third semiconductor laser element 933 is a blue laser beam.

The first, second and third semiconductor laser elements 931, 932, and 933 irradiate the scattering unit 160 with the laser beams. Therefore, red, green, and blue laser beams coexist in the scattering unit 160. Therefore, the light emitting device 900 emits white light from the light exit surface S1.

2. Modification

The modifications of the first embodiment may be appropriately combined with the fourth embodiment.

A. Supplementary Note

The light emitting device according to the first aspect includes the first semiconductor laser element, the second semiconductor laser element, and the light exit surface which emits light from the first semiconductor laser element and the second semiconductor laser element. The first semiconductor laser element is disposed at the position farther than the second semiconductor laser element as seen from the flat surface including a point on the surface of the light exit surface and perpendicular to the light extraction direction.

The light emitting device according to the second aspect includes the wavelength conversion unit which converts a wavelength of the laser beam and the scattering unit which scatters the laser beam. The wavelength conversion unit is disposed at the position farther than the scattering unit as seen from the light exit surface. The first semiconductor laser element irradiates the wavelength conversion unit with the laser beam. The second semiconductor laser element irradiates the scattering unit with the laser beam.

The light emitting device according to the third aspect includes the housing which houses the first semiconductor laser element, the second semiconductor laser element, the wavelength conversion unit, and the scattering unit. The housing includes a mirror surface on at least one of surfaces facing the wavelength conversion unit and the scattering unit.

In the light emitting device according to the fourth aspect, the housing includes a mirror surface inclined with respect to the light exit surface.

The light emitting device according to the fifth aspect includes the first opening part for making the laser beam from the first semiconductor laser element enter the wavelength conversion unit, and the second opening part for making the laser beam from the second semiconductor laser element enter the scattering unit.

In the light emitting device according to the sixth aspect, the first opening part is widened as approaching the wavelength conversion unit. The second opening part is widened as approaching the scattering unit.

The light emitting device according to the seventh aspect includes the first half mirror and the second half mirror. The first half mirror is disposed at the position between the first semiconductor laser element and the wavelength conversion unit. The second half mirror is disposed at the position between the second semiconductor laser element and the scattering unit.

The light emitting device according to the eighth aspect includes the light selective transmission member which transmits blue light and reflects yellow light. The light selective transmission member is disposed at the position between the first semiconductor laser element and the wavelength conversion unit.

The light emitting device according to the ninth aspect includes the scattering unit which scatters the laser beam. The wavelength of the laser beam of the first semiconductor laser element is different from that of the laser beam of the second semiconductor laser element. The first semiconductor laser element and the second semiconductor laser element irradiate the scattering unit with the laser beams.

The light emitting device according to the tenth aspect includes the third semiconductor laser element. The second semiconductor laser element is disposed at the position farther than the third semiconductor laser element as seen from the flat surface including the point on the surface of the light exit surface and perpendicular to the light extraction direction.

The light emitting device according to the eleventh aspect includes the scattering unit which scatters the laser beam. The wavelength of the laser beam of the first semiconductor laser element, the wavelength of the laser beam of the second semiconductor laser element and the wavelength of the laser beam of the third semiconductor laser element are different from each other. The first, second and third semiconductor laser elements irradiate the scattering unit with the laser beams.

The light emitting device according to the twelfth aspect includes the first wavelength conversion unit which converts the wavelength of the laser beam, the second wavelength conversion unit which converts the wavelength of the laser beam, and the scattering unit which scatters the laser beam. The wavelength of the laser beam converted by the second wavelength conversion unit is shorter than that of the laser beam converted by the first wavelength conversion unit. The second wavelength conversion unit is disposed at the position farther than the scattering unit as seen from the light exit surface. The first wavelength conversion unit is disposed at the position farther than the second wavelength conversion unit as seen from the light exit surface. The first semiconductor laser element irradiates the first wavelength conversion unit with the laser beam. The second semiconductor laser element irradiates the second wavelength conversion unit with the laser beam. The third semiconductor laser element irradiates the scattering unit with the laser beam.

The light emitting device according to the thirteenth aspect includes the diffusion half mirror surrounding a scattering layer on a side of the light exit surface.

In the light emitting device in the present specification, as seen from a direction opposite to the light extraction direction, the first semiconductor laser element is located behind (at an inner side of) the second semiconductor laser element. Therefore, an area occupied by the semiconductor laser element is halved. Meanwhile, the output of the laser beam is also approximately doubled. In addition, the light emitting device is miniaturized such that the area of the light exit surface is reduced. Therefore, the luminance of the light emitting device is high.

The present specification provides a light emitting device capable of realizing high luminance and miniaturization of the device.

What is claimed is:

1. A light emitting device comprising:

a first semiconductor laser element;

a second semiconductor laser element; and a light exit surface which emits light from the first semiconductor laser element and the second semiconductor laser element, wherein the first semiconductor laser element is disposed at a position farther than the second semiconductor laser element as seen from a flat surface including a point on a surface of the light exit surface and perpendicular to a light extraction direction.

2. The light emitting device according to claim 1 further comprising:

a wavelength conversion unit which converts a wavelength of a laser beam; and a scattering unit which scatters a laser beam, wherein the wavelength conversion unit is disposed at a position farther than the scattering unit as seen from the light exit surface, the first semiconductor laser element irradiates the wavelength conversion unit with a laser beam, and the second semiconductor laser element irradiates the scattering unit with a laser beam.

3. The light emitting device according to claim 2 further comprising:

a housing which houses the first semiconductor laser element, the second semiconductor laser element, the wavelength conversion unit, and the scattering unit, wherein the housing includes a mirror surface on at least one of surfaces facing the wavelength conversion unit and the scattering unit.

4. The light emitting device according to claim 3, wherein the housing includes a mirror surface inclined with respect to the light exit surface.

5. The light emitting device according to claim 2 further comprising:

a first opening part which allows the laser beam from the first semiconductor laser element to enter the wavelength conversion unit; and a second opening part which allows the laser beam from the second semiconductor laser element to enter the scattering unit.

6. The light emitting device according to claim 5, wherein the first opening part is widened as approaching the wavelength conversion unit, and the second opening part is widened as approaching the scattering unit.

7. The light emitting device according to claim 2 further comprising:

a first half mirror and a second half mirror, wherein the first half mirror is disposed at a position between the first semiconductor laser element and the wavelength conversion unit, and the second half mirror is disposed at a position between the second semiconductor laser element and the scattering unit.

8. The light emitting device according to claim 2 further comprising:

a light selective transmission member which transmits blue light and reflects yellow light, wherein the light selective transmission member is disposed at a position between the first semiconductor laser element and the wavelength conversion unit.

9. The light emitting device according to claim 1 further comprising:

a scattering unit which scatters a laser beam, wherein a wavelength of a laser beam of the first semiconductor laser element is different from a wavelength of a laser beam of the second semiconductor laser element, and the first semiconductor laser element and the second semiconductor laser element irradiate the scattering unit with the laser beams.

10. The light emitting device according to claim 1 further comprising:

a third semiconductor laser element, wherein the second semiconductor laser element is disposed at a position farther than the third semiconductor laser element as seen from the flat surface including the point on the surface of the light exit surface and perpendicular to the light extraction direction.

11. The light emitting device according to claim 10 further comprising:

a scattering unit which scatters a laser beam, wherein a wavelength of a laser beam of the first semiconductor laser element, a wavelength of a laser beam of the second semiconductor laser element and a wavelength of a laser beam of the third semiconductor laser element are different from each other, and the first, second and third semiconductor laser elements irradiate the scattering unit with the laser beams.

12. The light emitting device according to claim 10 further comprising:

a first wavelength conversion unit which converts a wavelength of a laser beam;

a second wavelength conversion unit which converts a wavelength of a laser beam; and a scattering unit which scatters a laser beam, wherein the wavelength of the laser beam converted by the second wavelength conversion unit is shorter than the wavelength of the laser beam converted by the first wavelength conversion unit, the second wavelength conversion unit is disposed at a position farther than the scattering unit as seen from the light exit surface, the first wavelength conversion unit is disposed at a position farther than the second wavelength conversion unit as seen from the light exit surface, the first semiconductor laser element irradiates the first wavelength conversion unit with a laser beam, the second semiconductor laser element irradiates the second wavelength conversion unit with a laser beam, and the third semiconductor laser element irradiates the scattering unit with a laser beam.

13. The light emitting device according to claim 1 further comprising:

a diffusion half mirror which surrounds a scattering layer on a side of the light exit surface side.

* * * * *